US010844287B2

(12) United States Patent
Fan et al.

(10) Patent No.: US 10,844,287 B2
(45) Date of Patent: Nov. 24, 2020

(54) METHOD AND APPARATUS FOR PREPARING GASOLINE AND AROMATICS BY USING FISCHER-TROPSCH SYNTHESIS EXHAUST

(71) Applicant: Institute of Coal Chemistry, Chinese Academy of Sciences, Shanxi (CN)

(72) Inventors: Weibin Fan, Shanxi (CN); Jianguo Wang, Shanxi (CN); Zhiwei Wu, Shanxi (CN); Mei Dong, Shanxi (CN); Zhangfeng Qin, Shanxi (CN); Huaqing Zhu, Shanxi (CN); Junfen Li, Shanxi (CN); Weiyong Jiao, Shanxi (CN)

(73) Assignee: INSTITUTE OF COAL CHEMISTRY, CHINESE ACADEMY OF SCIENCES, Shanxi ( * ) Notice: Subject to any disclaimer, the term of this patent is extended or adjusted under 35 U.S.C. 154(b) by 0 days.

(21) Appl. No.: 16/682,312

(22) Filed: Nov. 13, 2019

(65) Prior Publication Data

US 2020/0157433 A1 May 21, 2020

(30) Foreign Application Priority Data

Nov. 15, 2018 (CN) ..... 2018 1 1360175

(51) Int. Cl.
*C10G 2/00* (2006.01)
*C10L 1/06* (2006.01)

(52) U.S. Cl.
CPC ..... *C10G 2/334* (2013.01); *C10G 2/344* (2013.01); *C10L 1/06* (2013.01); *C10G 2300/1022* (2013.01); *C10G 2400/02* (2013.01); *C10L 2200/0423* (2013.01)

(58) Field of Classification Search
CPC ..... C10G 2300/1022; C10G 2400/02; C10G 2/334; C10G 2/344; C10L 1/06; C10L 2200/0423; C07C 11/02; C07C 2529/40
See application file for complete search history.

(56) References Cited

U.S. PATENT DOCUMENTS

2004/0064008 A1* 4/2004 Maurer ..... B01J 29/85 585/640
2010/0108568 A1* 5/2010 De Klerk ..... C10G 2/32 208/58
2018/0186707 A1* 7/2018 Abudawoud ..... C07C 2/12

* cited by examiner

*Primary Examiner* — Sharon Pregler
(74) *Attorney, Agent, or Firm* — Tutunjian & Bitetto, P.C.

(57) ABSTRACT

The present invention provides a method for preparing gasoline and aromatics by using Fischer-Tropsch synthesis exhaust. The method includes conducting an olefin conversion reaction on Fischer-Tropsch synthesis exhaust under the action of a first molecular sieve catalyst. A first refrigeration or cooling is conducted on an obtained product to obtain ultralow sulfur-containing gasoline and first-stage reaction gas. An alkaline aromatization reaction is conducted on the first-stage reaction gas under the action of a second molecular sieve catalyst. A second refrigeration or cooling is conducted on an obtained product to obtain aromatics. After the olefin conversion reaction, a gasoline component is separated and residual alkanes enter a second-stage fluidized bed reactor for the alkane aromatization reaction to produce aromatics. The present invention implements step conversion of different components in the Fischer-Tropsch exhaust, and has advantages of high reaction yield, easy catalyst regeneration and amplification, and the like.

12 Claims, 2 Drawing Sheets

METHOD AND APPARATUS FOR PREPARING GASOLINE AND AROMATICS BY USING FISCHER-TROPSCH SYNTHESIS EXHAUST

TECHNICAL FIELD

The present invention relates to the field of coal chemical technologies and petrochemical technologies, and in particular, to a method and an apparatus for preparing gasoline and aromatics by using Fischer-Tropsch synthesis exhaust.

BACKGROUND

Fischer-Tropsch synthesis (Fischer-Tropsch synthesis, FTS for short) is a method in which carbon-containing resources such as coal, natural gas, biomass are used as raw materials for indirect synthesis of oil products, and a Fischer-Tropsch synthesis product generally includes heavy oil, light oil, wax, synthetic water (containing oxygen-containing organic compounds such as alcohol, aldehyde, ketone, acid, and ester), $CO_2$, methane, low-carbon hydrocarbon, unreacted synthesis gas ($H_2$ and CO), and nitrogen gas. After being treated and separated, the Fischer-Tropsch synthesis product can be finally divided into liquid hydrocarbon, solid wax, waste water, and Fischer-Tropsch synthesis exhaust. Low-carbon hydrocarbons C4 or less can be obtained through simple separation of the Fischer-Tropsch exhaust. A content range of olefins in the low-carbon hydrocarbons is 50 to 80%, and a content range of alkanes is 20 to 50%. These low-carbon hydrocarbons are mainly used as fuel gas, but they have low utilization value, and lead to environmental pollution and a huge waste of resources. With rapid development of coal chemical technologies, this type of exhaust is increasing. Meanwhile, with rapid development of the national economy, a demand for gasoline and aromatics is constantly increasing. Converting these low-carbon hydrocarbons into high-quality gasoline and aromatics can not only improve product values, but also alleviate the contradiction between supply and demand of high-quality gasoline and aromatic products in China.

An origin of an aromatization technology of low-carbon hydrocarbons is that American UOP company and BP company jointly developed a cyclar technology ("Making aromatics from LPG", P C Doolan, P R Pujado, Hydrocarbon Processing, 1989, 9:72-76) in 1984. In the technology, a simulated moving bed regeneration technology and a Ga/ZSM-5 catalyst are used, and light dydrocarbons C3-C4 or liquefied petroleum gas are/is selectively converted into high value-added aromatics (mainly including benzene, toluene, and xylene) by one step. The method has advantages of high alkane conversion ratio and the like, but the technology is relatively complex. Nippon Mitsubishi Oil Corporation and Chiyoda Corporation have jointly developed a Z-Forming technology for producing aromatics and hydrogen gas from naphtha. In the technology, a reaction procedure in which fixed beds are alternately switched, and aromatic productivity is approximately 50 to 60%. In addition, different fixed bed technologies such as an Alapha technology, a Z-forming technology, an M2-Forming technology, and an Aro-Forming technology have been further developed.

Some technologies for preparing gasoline and aromatics from light hydrocarbon have also been developed in China. For example, Luoyang Petrochemical Engineering Corporation Ltd/SINOPEC has developed a GTA technology, and in the technology, three fixed beds are used, two fixed beds are started for use and one fixed bed stays on stand-by; and light hydrocarbons, oilfield light hydrocarbons, directly distilled gasoline, coker gasoline, and raffinate oil can be converted into high-octane gasoline and aromatics in the technology. SINOPEC Research Institute of Petroleum Processing has also developed a moving bed technology, and DAQI Technology Co., Ltd and Dalian University Of Technology have developed a Nano-forming fixed bed technology.

In all the foregoing methods, a fixed bed technology or a moving bed technology is used, and this type of technology has two disadvantages currently: First, reaction temperature of a fixed bed is not easy to control, and olefins are easily cracked or are subject to hydrogen transfer to produce alkanes, thereby leading to low yields of gasoline or aromatics. Second, there are the following disadvantages, for example, a catalyst is prone to be deactivated quickly, a regeneration condition of a fixed bed is complex, and it is difficult to replace a catalyst; and consequently, it is very difficult to implement large-scale development of this type of technology.

A fluidized bed technology has advantages of stable operating temperature, large raw material treatment capacity, easy catalyst regeneration, and the like. Chinese patent CN103908931A has reported a multilayer fluidized bed apparatus used for low-carbon hydrocarbon aromatization. Olefin conversion is mainly conducted at a lower layer, and alkane conversion is mainly conducted at a higher layer. However, a disadvantage of the method is that, a reaction is not easy to control, and aromatics formed in a low temperature area are easily subject to alkylation reaction with alkanes in a second stage to produce aromatics with a low utilization value, such as polymethylbenzene or polycyclic aromatic hydrocarbons.

SUMMARY

In view of this, an objective of the present invention is to provide a method and an apparatus for preparing gasoline and aromatics by using Fischer-Tropsch synthesis exhaust. The method provided in the present invention has a high conversion ratio of Fischer-Tropsch synthesis exhaust and high yields of gasoline and aromatics.

The present invention provides a method for preparing gasoline and aromatics by using Fischer-Tropsch synthesis exhaust, includes conducting an olefin conversion reaction on Fischer-Tropsch synthesis exhaust under the action of a first molecular sieve catalyst to obtain a first product. Then a cooling or refrigeration is conducted on the first obtained product to obtain an ultralow sulfur-containing gasoline and first-stage reaction gas, where a mass fraction of olefins C2 to C5 in the Fischer-Tropsch synthesis exhaust is 50 to 80 wt %, and the rest are alkanes C2 to C5. An alkane aromatization reaction is then conducted on the first-stage reaction gas under the action of a second molecular sieve catalyst to obtain a second product. A second cooling or refrigeration is conducted on the second obtained product to obtain aromatics.

In accordance with one preferred implementation, the temperature of the olefin conversion reaction is in a range of 300 to 420° C., the pressure is in a range of 0.1 to 1.0 MPa, and a mass space velocity is in a range of 0.5 to 10 $h^{-1}$.

According to another preferred embodiment, the first molecular sieve catalyst includes at least one ZSM-5, ZSM-12, and modified HZSM-5, where the modified HZSM-5 is Zn-modified HZSM-5 or Ga-modified HZSM-5.

A grain diameter of the first molecular sieve catalyst is in a range of 20 to 250 μm. The temperature of the alkane aromatization reaction is in a range of 500 to 580° C., the pressed is in a range of 0.1 to 0.5 MPa, and a mass space velocity is in a range of 0.2 to 2 $h^{-1}$. The second molecular sieve catalyst is modified HZSM-5, and the modified HZSM-5 includes one of Ag-modified HZSM-5, Fe-modified HZSM-5, La-modified HZSM-5, Mo-modified HZSM-5, Zn-modified HZSM-5, or Ga-modified HZSM-5.

A grain diameter of the second molecular sieve catalyst is 20 to 180 μm.

The temperature after first refrigeration is 15 to 30° C.

The present invention further provides a reaction apparatus for preparing gasoline and aromatics by using Fischer-Tropsch synthesis exhaust, including a one-stage fluidized bed heat exchanger (1), a one-stage fluidized bed preheater (2), a one-stage fluidized bed reactor (3), the one-stage fluidized bed heat exchanger (1), a one-stage fluidized bed cooler (4), a one-stage product separation tank (5), a two-stage fluidized bed heat exchanger (6), a two-stage fluidized bed preheater (8), a two-stage fluidized bed reactor (7), the two-stage fluidized bed heat exchanger (6), a two-stage fluidized bed cooler (9), a two-stage product separation tank (10), and a pressure swing adsorption separation apparatus (11) that are successively connected.

Preferably, the one-stage fluidized bed reactor (3) and the two-stage fluidized bed reactor (7) are independently a bubbling fluidized bed reactor, a circulating fluidized bed reactor, or a turbulent fluidized bed reactor.

Beneficial technical effects: In the present invention, after the hydrocarbon conversion reaction, a gasoline component is separated, and residual alkanes enter a second-stage fluidized bed reactor for an alkane aromatization reaction to produce aromatics, so as to avoid catalyst deactivation in the alkane aromatization reaction. The method has a high conversion ratio of Fischer-Tropsch synthesis exhaust, high yields of gasoline and aromatics, and low production of dry gas, and is easy for large-scale application. Experimental data of embodiments indicates that, in the method provided in the present invention, the olefin conversion ratio is larger than 95%; a yield of ultralow sulfur-containing gasoline can reach 40 to 64%; in the ultralow sulfur-containing gasoline, content of aromatics is above 40%, benzene content is below 0.5%, sulfur content is less than 2 ppm, and the ultralow sulfur-containing gasoline can be directly used as highly clean gasoline, and a mass yield of aromatics may reach 20 to 36%.

Figure 1:
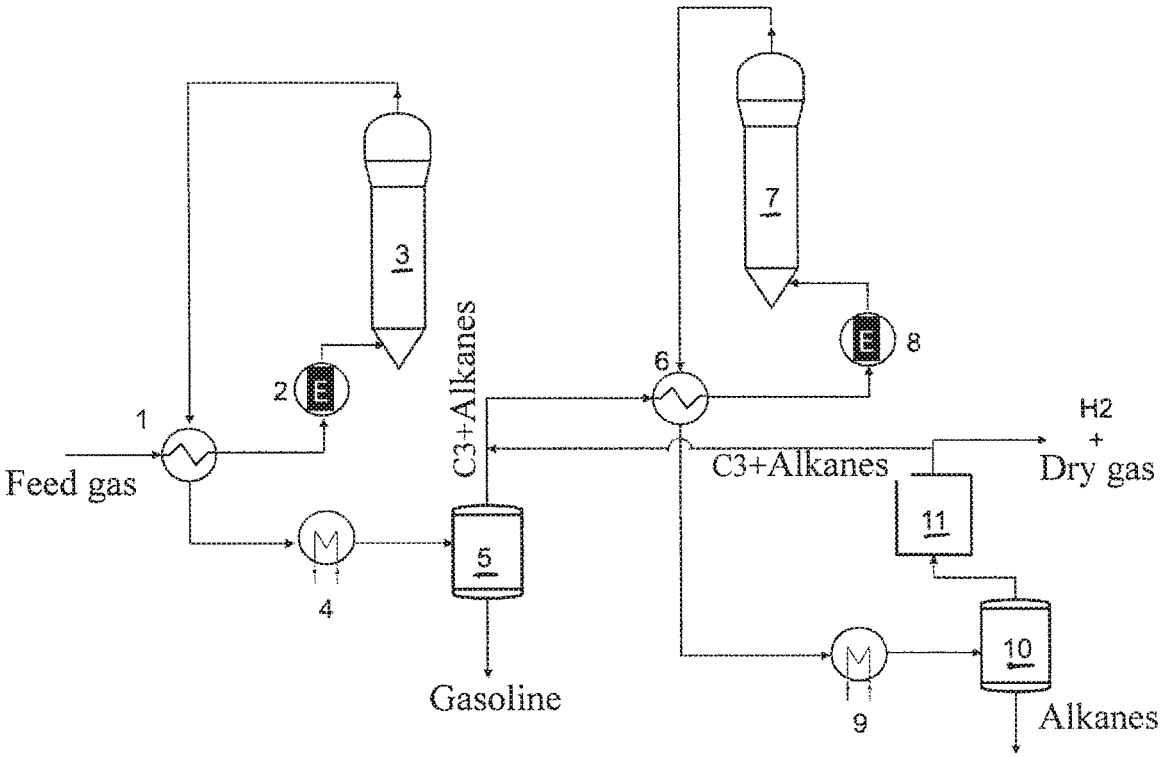
FIG. 1 is a schematic diagram of a reaction apparatus for preparing gasoline and aromatics by using Fischer-Tropsch synthesis exhaust according to an embodiment of the present invention.

In the drawings, the following are reference numerals are used: one-stage fluidized bed heat exchanger 1, one-stage fluidized bed preheater 2, one-stage fluidized bed reactor 3, one-stage fluidized bed cooler 4, one-stage product separation tank 5, two-stage fluidized bed heat exchanger 6, two-stage fluidized bed reactor 7, two-stage fluidized bed preheater 8, two-stage fluidized bed cooler 9, two-stage product separation tank 10, and pressure swing adsorption separation apparatus 11.

DETAILED DESCRIPTION

Figure 2:
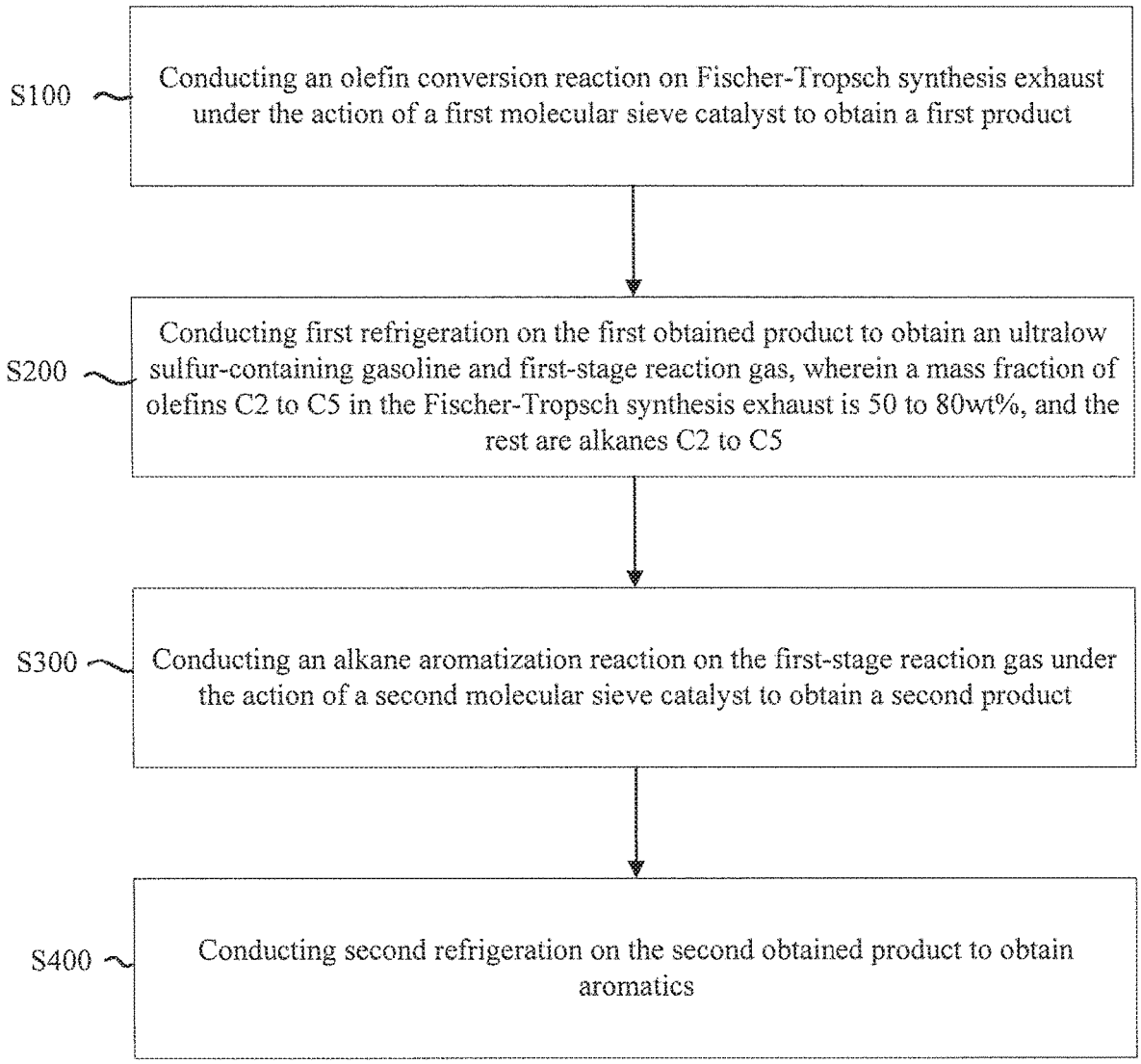
FIG. 2 is a flow diagram of the method for preparing gasoline and aromatics by using Fischer-Tropsch synthesis exhaust according to an embodiment of the present invention.

Referring to FIG. 2, the present invention provides a method for preparing gasoline and aromatics by using Fischer-Tropsch synthesis exhaust that includes conducting an olefin conversion reaction on Fischer-Tropsch synthesis exhaust under the action of a first molecular sieve catalyst to obtain a first product (S100). A first refrigeration or cooling is conducted on the first obtained product to obtain an ultralow sulfur-containing gasoline and first-stage reaction gas (S200), where a mass fraction of olefins C2 to C5 in the Fischer-Tropsch synthesis exhaust is 50 to 80 wt %, and the rest are alkanes C2 to C5. An alkane aromatization reaction is then conducted on the first-stage reaction gas under the action of a second molecular sieve catalyst to obtain a second product (S300). Finally, a second refrigeration or cooling is conducted on the second obtained product to obtain aromatics.

In the present invention, the olefin conversion reaction is conducted on the Fischer-Tropsch synthesis exhaust under the action of the first molecular sieve catalyst, and first cooling is conducted on the obtained product to obtain the ultralow sulfur-containing gasoline and the first-stage reaction gas.

In the present invention, the first molecular sieve catalyst preferably includes one or more of ZSM-5, ZSM-12, and modified HZSM-5 and is more preferably modified HZSM-5; and the modified HZSM-5 is Zn-modified HZSM-5 or Ga-modified HZSM-5. When the first molecular sieve catalyst is preferably a mixture of two or more catalysts, a proportion of the catalysts in the mixture is not specially limited in the present invention, and the catalysts can be mixed at any proportion. A grain diameter of the first molecular sieve catalyst is preferably 20 to 250 μm and more preferably 100 to 200 μm. A silicon-aluminum molar ratio of the first molecular sieve catalyst is preferably 15 to 100, more preferably 30 to 80, and most preferably 50 to 60.

According to an embodiment, the temperature of the olefin conversion reaction is preferably 300 to 420° C. and more preferably 320 to 380° C. The pressure of the olefin conversion reaction is preferably 0.1 to 1 Mpa and more preferably 1.3 to 0.6 Mpa, and a mass space velocity of the olefin conversion reaction is preferably 0.5 to 10 $h^{-1}$ and more preferably 2 to 6 $h^{-1}$.

According to an embodiment, before the olefin conversion reaction, the method further preferably includes preheating the Fischer-Tropsch synthesis exhaust and heating the Fischer-Tropsch synthesis exhaust to the temperature of the olefin conversion reaction. According to an embodiment, the temperature after preheating is preferably 200 to 250° C. and more preferably 220 to 240° C.

The first refrigeration or cooling preferably includes first cooling and second cooling.

The first cooling is preferably first cooling conducted by introducing the product obtained after the olefin conversion reaction into a heat exchanger, where temperature after the first cooling is preferably 200 to 300° C. and more preferably 230 to 250° C.

The second cooling is preferably cooling conducted by introducing the product obtained after the first cooling into a circulating water condenser, where temperature after the second cooling is preferably 15 to 20° C. and more preferably 18° C.

After the first cooling, the method further preferably includes separating the product obtained after the first cooling to obtain the ultralow sulfur-containing gasoline and the first-stage reaction gas.

According to an embodiment, the separation method is not specially limited, provided that a method well known by a person skilled in the art is used. In the present invention, a separation tank is preferably used for separation. In the present invention, separation temperature is preferably 15 to 30° C.

In accordance with the present invention, the ultralow sulfur-containing gasoline preferably includes isoparaffin, n-alkanes, olefins, aromatics, and sulfur. Because content of sulfur is lower than 2 ppm, sulfur can be ignored.

The olefin conversion reaction is used to separate an ultralow sulfur-containing gasoline component, residual first-stage reaction gas participates in the alkane aromatization reaction, so as to avoid reduction of a yield of aromatics and acceleration of catalyst regeneration that are caused because the ultralow sulfur-containing gasoline component enters a next-step reaction and is subject to another secondary reaction with the catalysts or leads to catalyst deactivation.

In the present invention, after the ultralow sulfur-containing gasoline and the first-stage reaction gas are obtained, the alkane aromatization reaction is conducted on the first-stage reaction gas under the action of the second molecular sieve catalyst, and second cooling is conducted on an obtained product to obtain aromatics.

According to another embodiment, the second molecular sieve catalyst is preferably modified HZSM-5, and the modified HZSM-5 preferably includes one or more of Ag-modified HZSM-5, Fe-modified HZSM-5, La-modified HZSM-5, Mo-modified HZSM-5, Zn-modified HZSM-5, or Ga-modified HZSM-5 and more preferably one or more of Fe-modified HZSM-5, Zn-modified HZSM-5, or Ga-modified HZSM-5. When the second molecular sieve catalyst is a mixture of two or more catalysts, dosages of various catalysts in the mixture are not specially limited in the present invention, and the catalysts can be mixed at any proportion. A grain diameter of the second molecular sieve catalyst is preferably 20 to 180 μm, more preferably 50 to 150 μm, and needs to be preferably 100 to 120 μm. A silicon-aluminum molar ratio of the second molecular sieve catalyst is preferably 15 to 60 and more preferably 20 to 50.

According to an embodiment, the temperature of the alkane aromatization reaction is preferably 500 to 580° C. and more preferably 520 to 550° C., the pressure is 0.1 to 0.5 Mpa and more preferably 0.2 to 0.3 Mpa, and the mass space velocity is 0.2 to 2 $h^{-1}$ and more preferably 0.5 to 1.5 $h^{-1}$.

According to another embodiment, the second refrigeration or cooling is preferably first cooling and second cooling conducted on the product obtained after the alkane aromatization reaction.

The first cooling is preferably first cooling conducted by introducing the product obtained after the alkane aromatization reaction into a heat exchanger, where temperature after the first cooling is preferably 200 to 300° C. and more preferably 230 to 250° C.

The second cooling is preferably cooling conducted by introducing the product obtained after the first cooling into a circulating water condenser, where temperature after the second cooling is preferably 15 to 25° C. and more preferably 20° C.

After the second cooling, the method further includes conducting gas-liquid separation on the product obtained after the second cooling to obtain aromatics and second-stage reaction gas.

According to an embodiment, the separation method is not specially limited, provided that a method well known by a person skilled in the art is used. In the present invention, a separation tank is preferably used for separation.

In yet another embodiment, pressure swing adsorption separation is preferably conducted on the second-stage reaction gas to obtain hydrogen gas, dry gas, and olefins and alkanes C3 or more. Low-carbon hydrocarbons in the olefins and alkanes C3 or more can be added into the first-stage reaction gas for cycle use.

The present invention further provides a reaction apparatus for preparing gasoline and aromatics by using Fischer-Tropsch synthesis exhaust, including a one-stage fluidized bed heat exchanger (1), a one-stage fluidized bed preheater (2), a one-stage fluidized bed reactor (3), the one-stage fluidized bed heat exchanger (1), a one-stage fluidized bed cooler (4), a one-stage product separation tank (5), a two-stage fluidized bed heat exchanger (6), a two-stage fluidized bed preheater (8), a two-stage fluidized bed reactor (7), the two-stage fluidized bed heat exchanger (6), a two-stage fluidized bed cooler (9), a two-stage product separation tank (10), and a pressure swing adsorption separation apparatus (11) that are successively connected.

Preferably, the one-stage fluidized bed reactor (3) and the two-stage fluidized bed reactor (7) are independently a bubbling fluidized bed reactor, a circulating fluidized bed reactor, or a turbulent fluidized bed reactor.

In the present invention, the Fischer-Tropsch reaction gas is introduced into the one-stage fluidized bed heat exchanger 1 for preheating, and is heated to temperature of an olefin conversion reaction by using the one-stage fluidized bed preheater 2. The Fischer-Tropsch synthesis exhaust enters the one-stage fluidized bed reactor 3 for the olefin conversion reaction under the action of a catalyst. and the product obtained after the reaction enters the one-stage fluidized bed heat exchanger 1 again for first cooling, enters the one-stage fluidized bed cooler 4 for second cooling, and then is subject to separation by using the one-stage product separation tank 5 to obtain ultralow sulfur-containing gasoline and first-stage reaction gas.

The first-stage reaction gas is introduced into the two-stage fluidized bed heat exchanger 6 for preheating, and is heated to temperature of an alkane aromatization reaction by using the two-stage fluidized bed preheater 8. The Fischer-Tropsch synthesis exhaust enters the two-stage fluidized bed reactor 7 for the alkane aromatization reaction under the action of a catalyst, and the obtained product is introduced into the two-stage fluidized bed heat exchanger 6 for first cooling, enters the two-stage fluidized bed cooler 9 for second cooling, and then is subject to separation by using the two-stage product separation tank 10 to obtain aromatics and second-stage reaction gas. The second-stage reaction gas is allowed to pass through the pressure swing adsorption separation apparatus 11 to separate out hydrogen gas, dry gas, and olefins and alkanes C3 or more, and the low-carbon hydrocarbons in the olefins and alkanes C3 or more can be added into the first-stage reaction gas and together enters the two-stage fluidized bed heat exchanger 6 for cycle use.

To better understand the present invention, the following further describes in detail content of the present invention with reference to embodiments, but the content of the present invention is not limited to the following embodiments.

Embodiment 1

Fischer-Tropsch synthesis exhaust (mass fractions of ethane, ethylene, propane, propylene, butane, and butene are respectively 10%, 20%, 15%, 30%, 10%, and 15%) is introduced into the one-stage fluidized bed heat exchanger 1 for preheating, where temperature after preheating is 200° C. The Fischer-Tropsch synthesis exhaust is heated to 350 to 355° C. by using the one-stage fluidized bed preheater 2, and enters the one-stage fluidized bed reactor 3 for an olefin conversion reaction, where a Zn3.5/HZSM-5 (a silicon-aluminum molar ratio is 70) catalyst is used, and a reaction space velocity is 1.5 $h^{-1}$. The product gas obtained after the reaction enters the one-stage fluidized bed heat exchanger 1 for first cooling to 300° C., then enters the one-stage fluidized bed cooler 4 for second cooling to 15 to 20° C., and is subject to separation by using the one-stage product separation tank 5 to separate out a gasoline component, to obtain first-stage reaction gas and high-quality ultralow sulfur-containing gasoline containing aromatics with mass content of 42.4%. An olefin conversion rate is 96.5%, and a gasoline mass yield reaches 49.8%. Gasoline components are shown in Table 1.

The first-stage reaction gas is introduced into the two-stage fluidized bed heat exchanger 6 for preheating. After being preheated to 200° C., the first-stage reaction gas is heated to 550° C. by using the two-stage fluidized bed preheater 8, and enters the two-stage fluidized bed reactor 7 for an alkane aromatization reaction, where a Ga1.8Ag0.3/HZSM-5 (silicon-aluminum molar ratio is 15) catalyst is used, and a reaction space velocity is 0.4 $h^{-1}$. The obtained product gas enters the two-stage fluidized bed heat exchanger 6 for first cooling to 300° C., then enters the two-stage fluidized bed cooler 9 for second cooling to 25° C., and is subject to separation by using the two-stage product separation tank 10 to obtain aromatics and second-stage reaction gas. The second-stage reaction gas is allowed to pass through the pressure swing adsorption separation apparatus 11 to separate out hydrogen gas, dry gas, and olefins and alkanes C3 or more, and the low-carbon hydrocarbons in the olefins and alkanes C3 or more are added into the first-stage reaction gas and together enters the two-stage fluidized bed heat exchanger 6 for cycle use. An alkane conversion ratio of the reaction reaches 89.4%, and a yield of aromatics reaches 27.1%. Related components are shown in Table 2. Through calculation, a total liquid yield ratio of gasoline and aromatics in this embodiment reaches 76.9 wt %.

TABLE 1

Components of ultralow sulfur-containing gasoline in Embodiment 1

| Items | Content (wt %) |
|---|---|
| Isoparaffin | 30.4 |
| N-alkanes | 9.1 |
| Olefins | 18.1 |
| Aromatics | 42.4 |

TABLE 2

Components of aromatics in Embodiment 1

| Items | Content (wt %) |
|---|---|
| Benzene | 30.4 |
| Toluene | 35.4 |

TABLE 2-continued

Components of aromatics in Embodiment 1

| Items | Content (wt %) |
|---|---|
| Xylene | 14.1 |
| A9+ | 20.1 |

Embodiment 2

Fischer-Tropsch synthesis exhaust (mass fractions of ethane, ethylene, propane, propylene, butane, and butene are respectively 10%, 30%, 5%, 30%, 10%, and 15%) is introduced into the one-stage fluidized bed heat exchanger 1 for preheating, where temperature after preheating is 230° C. The Fischer-Tropsch synthesis exhaust is heated to 300 to 325° C. by using the one-stage fluidized bed preheater 2, and enters the one-stage fluidized bed reactor 3 for an olefin conversion reaction, where a Zn3.5/HZSM-5 (a silicon-aluminum molar ratio is 50) catalyst is used, and a reaction space velocity is 3 $h^{-1}$. The product gas obtained after the reaction enters the one-stage fluidized bed heat exchanger 1 for first cooling to 200° C., then enters the one-stage fluidized bed cooler 4 for second cooling to 15 to 20° C., and is subject to separation by using the one-stage product separation tank 5 to separate out a gasoline component, and thereby obtain first-stage reaction gas and high-quality ultralow sulfur-containing gasoline containing aromatics with mass content of 43.5%. An olefin conversion ratio is 98.5%, and a gasoline yield reaches 59.4%. Related components are shown in Table 3.

The first-stage reaction gas is introduced into the two-stage fluidized bed heat exchanger 6 for preheating. After being preheated to 260° C., the first-stage reaction gas is heated to 550° C. by using the two-stage fluidized bed preheater 8, and enters the two-stage fluidized bed reactor 7 for an alkane aromatization reaction, where a Ga1.8/HZSM-5 (silicon-aluminum molar ratio is 25) catalyst is used, and a reaction space velocity is 2 $h^{-1}$; obtained product gas enters the two-stage fluidized bed heat exchanger 6 for first cooling to 200° C., then enters the two-stage fluidized bed cooler 9 for second cooling to 20° C., and is subject to separation by using the two-stage product separation tank 10 to obtain aromatics and second-stage reaction gas. The second-stage reaction gas is allowed to pass through the pressure swing adsorption separation apparatus 11 to separate out hydrogen gas, dry gas, and olefins and alkanes C3 or more, and the low-carbon hydrocarbons in the olefins and alkanes C3 or more are added into the first-stage reaction gas and together enters the two-stage fluidized bed heat exchanger 6 for cycle use. An alkane conversion ratio of the reaction reaches 85.4%, and a yield of aromatics can reach 20.5%. Related components are shown in Table 4. Through calculation, a total liquid yield ratio of gasoline and aromatics in this embodiment reaches 79.9 wt %.

TABLE 3

Components of ultralow sulfur-containing gasoline in Embodiment 2

| Items | Content (wt %) |
|---|---|
| Isoparaffin | 35.2 |
| N-alkanes | 11.1 |

TABLE 3-continued

| Components of ultralow sulfur-containing gasoline in Embodiment 2 | |
|---|---|
| Items | Content (wt %) |
| Olefins | 10.2 |
| Aromatics | 43.5 |

TABLE 4

| Components of aromatics in Embodiment 2 | |
|---|---|
| Items | Content (wt %) |
| Benzene | 28.6 |
| Toluene | 38.4 |
| Xylene | 16.1 |
| A9+ | 16.9 |

The foregoing descriptions are only preferred implementation manners of the present invention. It should be noted that for a person of ordinary skill in the art, several improvements and modifications may further be made without departing from the principle of the present invention. These improvements and modifications should also be deemed as falling within the protection scope of the present invention.

What is claimed is:

1. A reaction apparatus for preparing gasoline and aromatics by using Fischer-Tropsch synthesis exhaust, comprising:

a one-stage fluidized bed heat exchanger (1) having one input for receiving feed gas and a second input, and a first output and a second output;

a one-stage fluidized bed preheater (2) having an input connected to the first output of one-stage fluidized bed heat exchanger (1) and an output;

a one-stage fluidized bed reactor (3) having an input connected to the output of one-stage fluidized bed preheater (2) and output connected to the second input of the one-stage fluidized bed heat exchanger (1);

a one-stage fluidized bed cooler (4) having an input connected to the second output of the one-stage fluidized bed heat exchanger (1) and an output;

a one-stage product separation tank (5) having an input connected to the output of the one-stage fluidized bed cooler (4) and a first output and a second output being a gasoline output, a two-stage fluidized bed heat exchanger (6) having a first input connected to the first output of the one-stage product separation tank (5), as second input and a first and second output;

a two-stage fluidized bed reactor (7) having an output connected to the second input of two-stage fluidized bed heat exchanger (6);

a two-stage fluidized bed preheater (8) having an input connected to the first output of two-stage fluidized bed heat exchanger (6) and an output connected to the input of the two-stage fluidized bed reactor (7);

a two-stage fluidized bed cooler (9) having an input connected to the second output of the two-stage fluidized bed heat exchanger (6) and an output;

a two-stage product separation tank (10) having an input connected to the output of the two-stage fluidized bed cooler (9), a first output and a second output for alkanes; and a pressure swing adsorption separation apparatus (11) having an input connected to the output of the two-stage product separation tank (10) and having an output connected to the first input of the two-stage fluidized bed heat exchanger (6).

2. The reaction apparatus according to claim 1, wherein the one-stage fluidized bed reactor (3) and the two-stage fluidized bed reactor (7) are independently one of a bubbling fluidized bed reactor, a circulating fluidized bed reactor, or a turbulent fluidized bed reactor.

3. A method for preparing gasoline and aromatics by using Fischer-Tropsch synthesis exhaust with the reaction apparatus in claim 1, comprising:

conducting an olefin conversion reaction on Fischer-Tropsch synthesis exhaust under the action of a first molecular sieve catalyst to obtain a first product;

conducting first refrigeration on the first obtained product to obtain an ultralow sulfur-containing gasoline and first-stage reaction gas, wherein a mass fraction of olefins C2 to C5 in the Fischer-Tropsch synthesis exhaust is 50 to 80 wt %, and the rest are alkanes C2 to C5;

conducting an alkane aromatization reaction on the first-stage reaction gas under the action of a second molecular sieve catalyst to obtain a second product; and conducting second refrigeration on the second obtained product to obtain aromatics.

4. The method according to claim 3, wherein a temperature of the olefin conversion reaction is in a range of 300 to 420° C., a pressure is in a range of 0.1 to 1.0 MPa, and a mass space velocity is in a range of 0.5 to 10 $h^{-1}$.

5. The method according to claim 3, wherein the first molecular sieve catalyst comprises one or more of ZSM-5, ZSM-12, and modified HZSM-5, the modified HZSM-5 being Zn-modified HZSM-5 or Ga-modified HZSM-5.

6. The method according to claim 3, wherein a grain diameter of the first molecular sieve catalyst is in a range of 20 to 250 μm.

7. The method according to claim 5, wherein a grain diameter of the first molecular sieve catalyst is in a range of 0 to 250 μm.

8. The method according to claim 3, wherein a temperature of the alkane aromatization reaction is in a range of 500 to 580° C., a pressure is in a range of 0.1 to 0.5 MPa, and a mass space velocity is in a range of 0.2 to 2 $h^{-1}$.

9. The method according to claim 3, wherein the second molecular sieve catalyst comprises a modified HZSM-5, where the modified HZSM-5 comprises one selected from a group consisting of Ag-modified HZSM-5, Fe-modified HZSM-5, La-modified HZSM-5, Mo-modified HZSM-5, Zn-modified HZSM-5, and Ga-modified HZSM-5.

10. The method according to claim 3, wherein a grain diameter of the second molecular sieve catalyst is in a range of 20 to 180 μm.

11. The method according to claim 9, wherein a grain diameter of the second molecular sieve catalyst is in a range of 20 to 180 μm.

12. The method according to claim 3, wherein temperature after first refrigeration is in a range of 15 to 30° C.

* * * * *